United States Patent [19]

Freeman, Jr. et al.

[11] 3,934,553

[45] Jan. 27, 1976

[54] COMBINED WALL BURNER AND FLAMEHOLDER FOR HRSG

[75] Inventors: James M. Freeman, Jr., West Newbury; Bruce E. Gans, Beverly; Sotiris Lambiris, Andover, all of Mass.; Donald E. Woodmansee, Schenectady, N.Y.

[73] Assignee: General Electric Company, Schenectady, N.Y.

[22] Filed: Jan. 6, 1975

[21] Appl. No.: 538,952

[52] U.S. Cl. ..... 122/7 B; 431/350; 432/222

[51] Int. Cl.[2] ..... F22B 1/18; F23D 13/24

[58] Field of Search ..... 122/7 R, 7 B; 431/350; 432/222

[56] References Cited

UNITED STATES PATENTS

| | | | |
|---|---|---|---|
| 3,247,838 | 4/1966 | Frick | 431/350 |
| 3,366,373 | 1/1968 | Reed | 432/222 |
| 3,443,550 | 5/1969 | May et al. | 122/7 |
| 3,732,059 | 5/1973 | Goodnight, et al. | 432/222 |
| 3,843,309 | 10/1974 | Lambiris | 431/350 |

*Primary Examiner*—Kenneth W. Sprague
*Attorney, Agent, or Firm*—John F. Ahern; James W. Mitchell

[57] ABSTRACT

In a combined cycle power plant, gas turbine exhaust gas is passed through a heat recovery steam generator (HRSG) wherein it may be reheated upstream from a boiler tube section prior to passing through the boiler tube section in a non-contact heat exchange relation with a feedwater supply to produce steam for driving a steam turbine. A plurality of air-atomized, liquid fuel wall burners are utilized, each in combination with a "vee"-shaped flameholder to heat the gas turbine exhaust gas. Each wall burner may be disposed in a recessed opening in the HRSG duct wall and each wall burner has a nozzle portion which may be directed upstream relative to the exhaust gas flow. Each flameholder is approximately parallel to its respective wall burner nozzle axis having one end fixed to the duct wall, upstream from the nozzle axis, and a free end disposed within the HRSG duct.

16 Claims, 4 Drawing Figures

Fig. 1
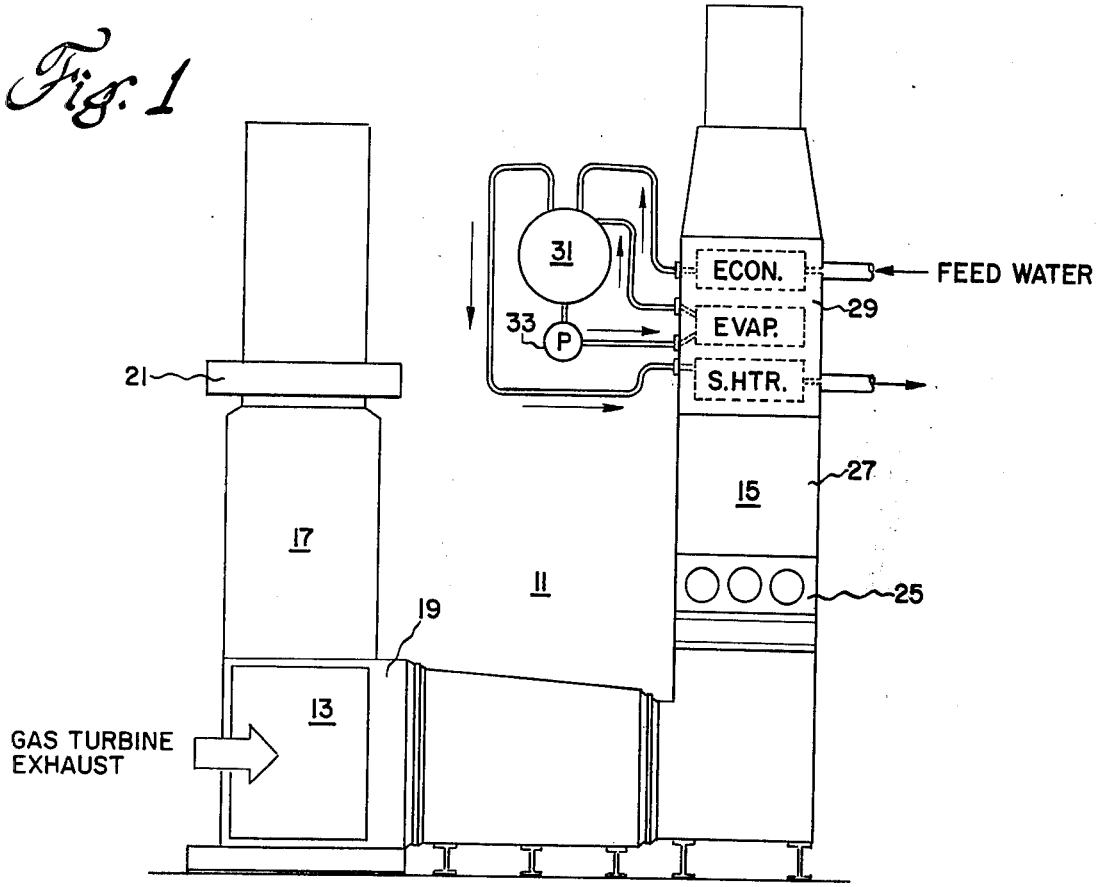
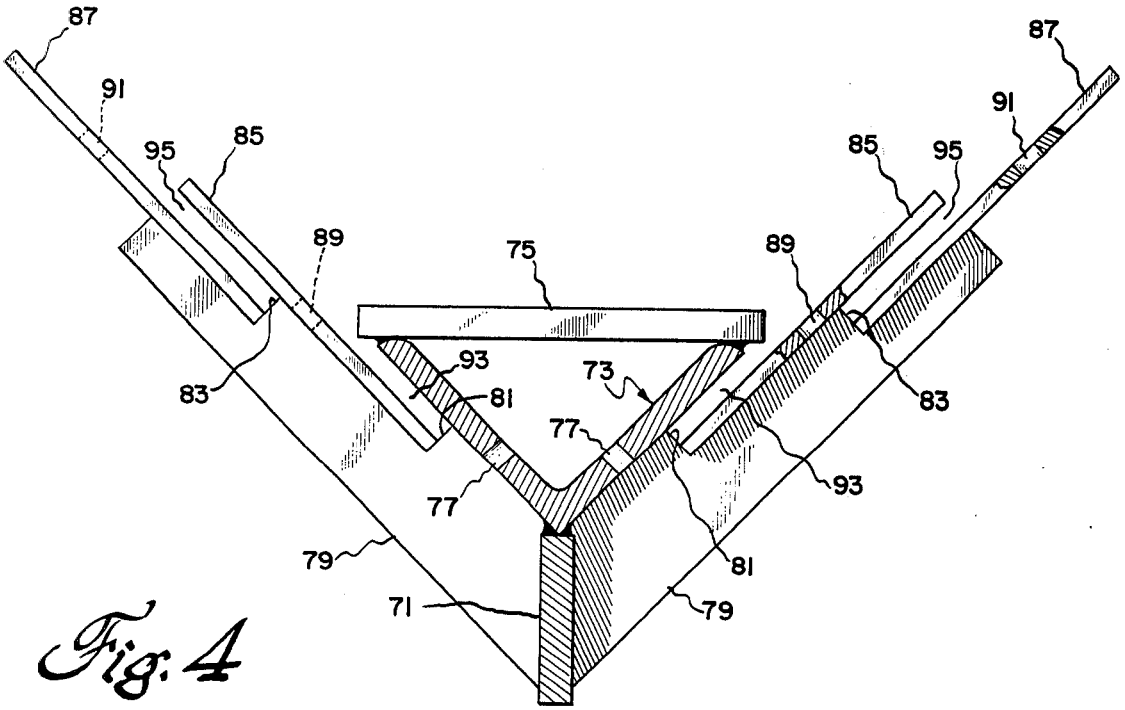
Fig. 4

COMBINED WALL BURNER AND FLAMEHOLDER FOR HRSG

BACKGROUND OF THE INVENTION

This invention relates, in general, to combined cycle power plants; and, in particular, this invention is directed to a means for raising gas turbine exhaust gas temperatures in a heat recovery steam generator upstream from a steam generating boiler tube section.

One application of the present invention is found in a heat recovery steam generator (HRSG) of a combined cycle power plant wherein gas turbine hot exhaust gases are passed through a duct containing a boiler tube section whereby a heat transfer is effected between the hot exhaust gases and the fluid in the boiler tube section to produce steam for driving a steam turbine. Moreover, it is sometimes desirable to raise the temperature of the hot exhaust gas, either intermittently or continuously, upstream from the boiler tube section in which case the HRSG is referred to as being "fired". One prior art means for firing an HRSG is a grid burner of the type shown in U.S. Pat. No. 3,830,620 to Frederick J. Martin, issued Aug. 20, 1974. In general, a grid burner includes a network of fuel supplied pipes which are disposed within and across the cross-sectional area of the HRSG duct. Each pipe includes a plurality of fuel outlet ports on the downstream circumference of the pipe. In a grid burner, fuel is delivered through the grid pipes and ignited at the outlet ports on the downstream circumference of the pipe by pilot burners which are mounted transversely and adjacent to the grid pipes downstream therefrom.

One limitation inherent in the grid burner system is the possibility that the fuel pipes in the grid burners may become plugged. This is because temperature affects fuel viscosity and the fuel pipes are disposed in the HRSG duct which is subject to wide temperature variations dependent upon gas turbine operating conditions. Solutions to this problem are available in the form of purging means and/or insulation means for the fuel pipes; and, limiting the fuel used to distillate oils or natural gas. In the event that fuel pipe clogging should occur, maintenance requires access to the HRSG duct or, in the alternative, a solution such as that shown in U.S. Pat. No. 3,843,309 to Lambiris, issued Oct. 22, 1974 wherein the fuel pipe is removable from the burner pipe.

According to the present invention, the disadvantages of the grid burner system are obviated by providing a wall burner system for heating gas turbine exhaust gases whereby all fuel delivery means are disposed outside the HRSG duct. The wall burners are provided in combination with flameholders which are disposed within the HRSG duct but the flameholders do not contain any fuel delivery pipes and therefore are not susceptible to fuel pipe clogging. Moreover, the wall burners may be operable on relatively inexpensive residual fuel oils. The wall burners may be directed upstream into the exhaust gas flow and each wall burner includes an associated vee-shaped flameholder which may also be directed upstream into the exhaust gas flow approximately parallel to the burner axis. Ignition occurs within the wall burner and the flameholder attracts the emitted flame along the flameholder length thereby preventing the flames from being lifted downstream to the boiler tube section by the turbine exhaust gas flow.

The directing of the wall burner upstream into the exhaust gas flow allows the flame length to be maximized across the HRSG duct. Moreover, a shorter duct is required between the combustion section and the boiler tube section since the flames are directed away from the boiler tubes.

It is one object of the present invention to provide a means for firing an HRSG which obviates the occurrence of fuel pipe clogging.

It is another object of the present invention to provide a means for firing an HRSG which may be operated on residual fuels.

It is another object of the present invention to provide a means for firing an HRSG which is more economical to construct, operate and maintain than prior art devices.

The novel features believed characteristic of the present invention are set forth in the appended claims. The invention itself, however, together with further objects and advantages thereof, may best be understood with reference to the following description taken in connection with the appended drawings.

BRIEF DESCRIPTION OF THE DRAWINGS

FIG. 1 is an elevation view of an HRSG including gas turbine and steam turbine fluid connections.

FIG. 4 is a cross-section view of a flameholder.

DETAILED DESCRIPTION OF THE INVENTION

Figure 2:
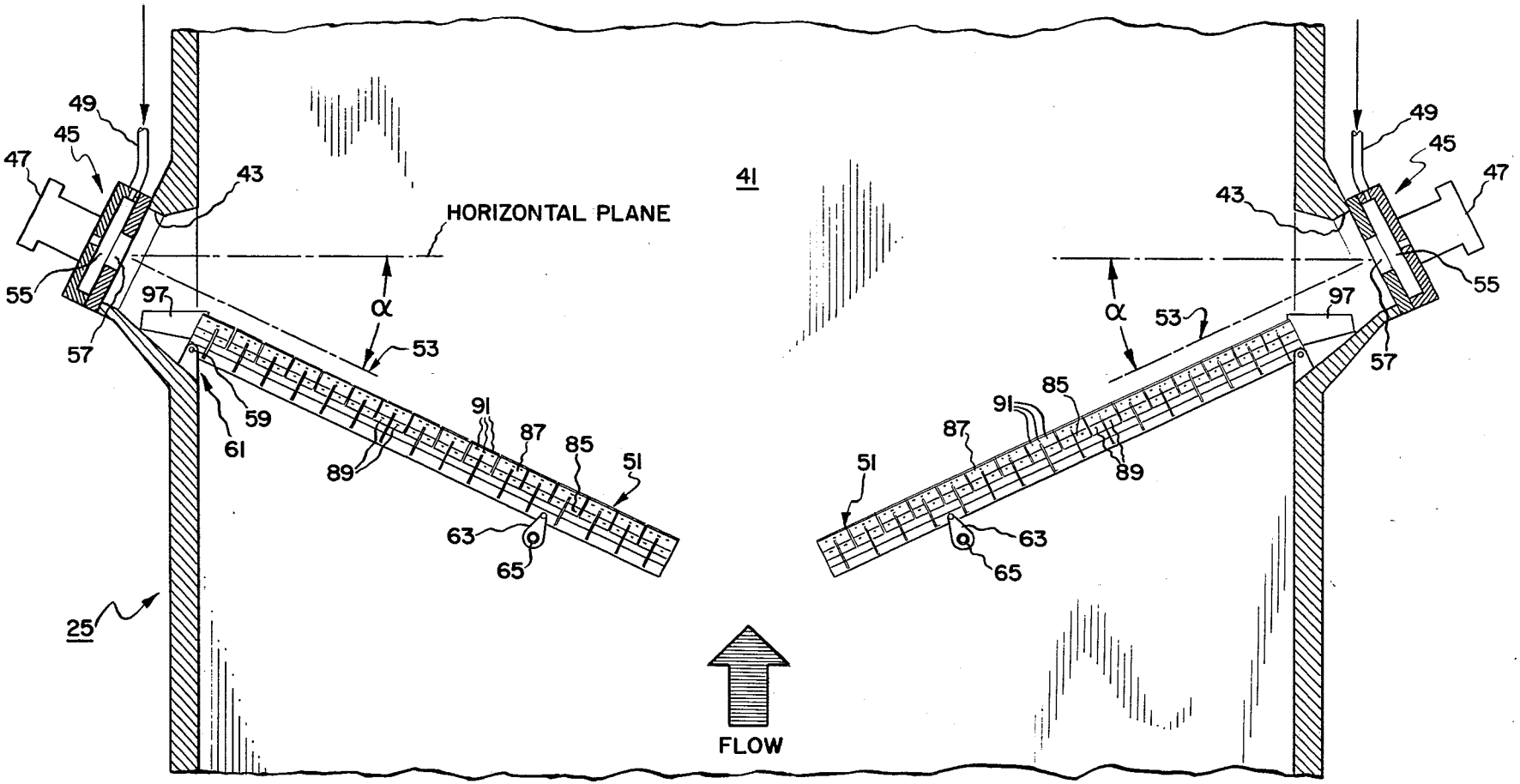
FIG. 2 is an elevation cross-section of an HRSG combustion section with the present invention incorporated therein.

FIG. 1 shows a heat recovery steam generator 11 of the type which is used in combined cycle power plants. At one end, a gas turbine (not shown) provides hot exhaust gas into an exhaust gas inlet 13. The exhaust gas flow may be divided between a main HRSG stack 15 and a bypass stack 17 in proportions determined by an isolation damper 19 and a bypass damper 21. The desired proportion of gas to the HRSG stack will depend upon the gas turbine exhaust temperature and flow volume; and, the steam turbine (not shown) operating demands. The exhaust gas passing through the isolation damper into the HRSG stack is channeled through a combustion section 25 where it is heated according to the present invention. The combustion section may be fired continuously or intermittently. Heated gas is then passed through a lower transition duct 27 to a boiler section 29.

The boiler section may be comprised of an economizer, an evaporator and a superheater with the economizer receiving feedwater and the superheater being connected to a steam header which, in turn, is connected to a steam turbine (not shown). The heated gas turbine exhaust gas is passed in a non-contact heat transfer relation with the feedwater to provide steam for a steam turbine (not shown). Also, a steam evaporator drum 31 and recirculation pump 33 are provided in conjunction with the boiler tube section. The foregoing is a general description of one environment in which the present invention may be advantageously employed.

Figure 3:
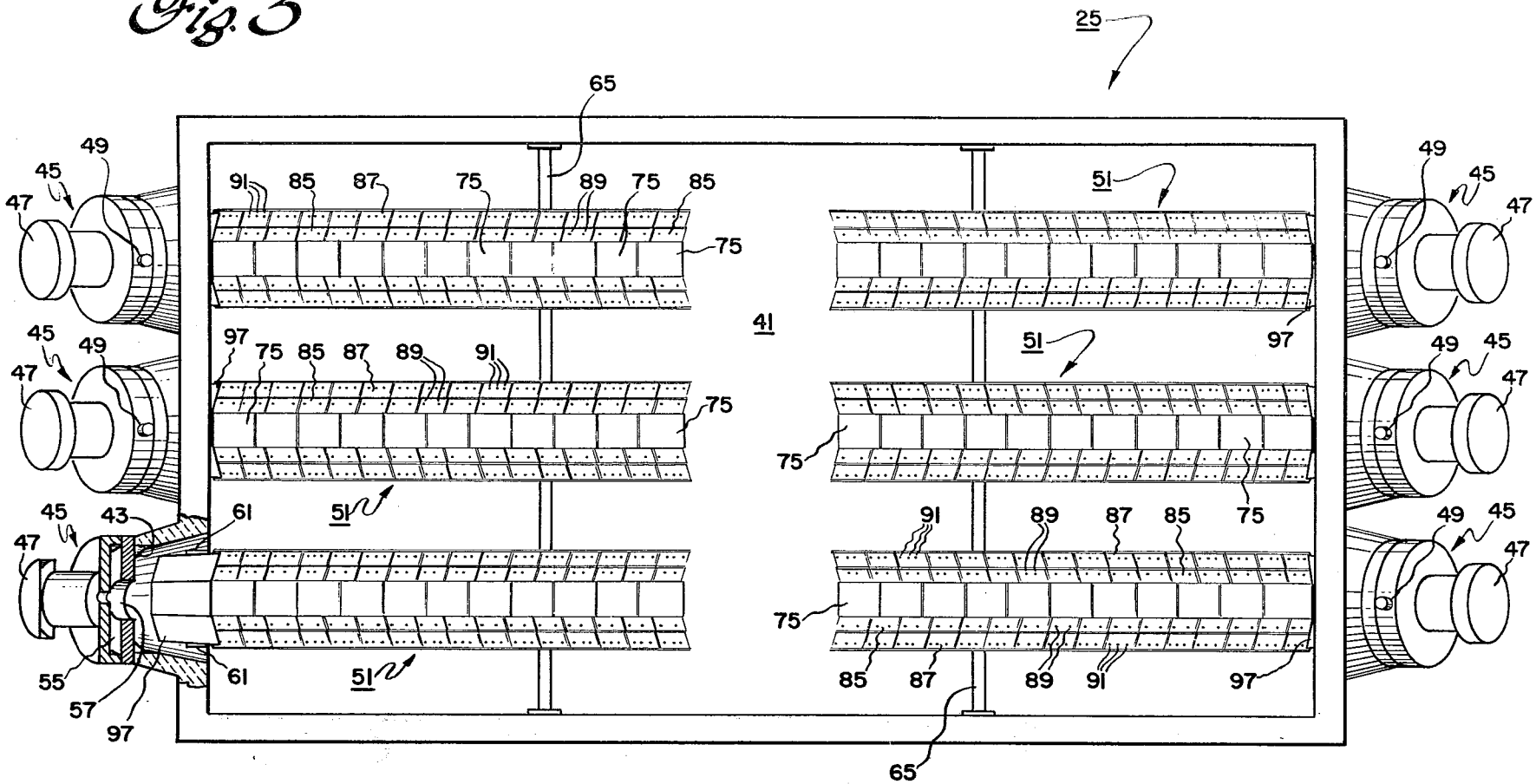
FIG. 3 is a plan cross section of an HRSG combustion section looking upstream into the exhaust gas flow.

Referring now to FIGS. 2 and 3, which are respectively elevation and plan cross-sections of the combustion section 25, it is apparent that the combustion section may be a rectangular duct 41, through which gas turbine exhaust gases are channeled. In one embodiment, the shorter sidewalls of the duct are formed with recessed opposite openings 43 for accommodating a plurality of opposite wall burners 45. The wall burners may be air-atomized, liquid fuel wall burners, each burner including a liquid fuel supply manifold 47 and an atomizing air supply manifold 49. According to the present invention, each wall burner is used in combination with a vee-shaped flameholder 51. Each wall burner has a nozzle axial centerline 53 which may be directed upstream into the exhaust gas at an angle $\alpha$ from a horizontal plane normal to the direction of the exhaust gas flow. Each flameholder may also be directed upstream into the exhaust gas flow approximately parallel to its respective burner axial centerline and hence at an angle approximately equal to $\alpha$ with respect to a plane normal to the direction of the exhaust gas flow. The upstream orientation of the wall burner centerline and the flameholder effects at least two important results. One result is that the flameholder length and therefore the flame length is maximized because, in effect, the flameholder is the hypotenuse of a right triangle, the other two legs being a horizontal line normal to the exhaust gas flow and a vertical line connecting the horizontal line and the free end of the flameholder. The other result is that since the burner and flameholder are directed away from the boiler tube section, then the length of the lower transition duct 27 may be minimized (FIG. 1). The angle $\alpha$ may generally be any convenient angle between 0° and 45°, although the present invention is not limited to this range.

The burners are air-atomized, liquid fuel burners capable of operating on residual fuels. One example of such a burner is a "Gasiform" burner obtainable from Voorheis Industries Inc. of Caldwell, N.J. In the Gasiform burners, oil and air are mixed in an inner chamber 55 and ignited by a gas or oil igniter (not shown) contained within each wall burner. After ignition, the combustion products including flame and unburned fuel and air are directed through the burner throat 57 upstream into the exhaust gas flow along the flameholder length.

Each flameholder 51 is an elongated vee-shaped trough attached at one end to the burner wall by means of pin 59 and bracket 61. The free end of each flameholder is movably supported by a bracket 63 attached to a pipe support fixture 65 extending across the combustion section duct.

Referring to FIG. 4, each flameholder functions to attract the combustion products from its respective wall burner by providing a low-pressure trough upstream from the wall burner. Moreover, each flameholder must provide sufficient primary air to support combustion of burned combustion products along the length of the flameholder. Pupsuant to these requirements each flameholder comprises a main support beam configuration comprising an angle 73 running the entire length of the flameholder and reinforced by a flat bar rib 71, also along its length. A plurality of radiation shields 75 are mounted across the open vee of the angle to reflect heat from the wall burner flame. The underside of each radiation shield is cooled by the relatively cool gas turbine exhaust gas through a plurality of cooling holes 77 along the length of the angle 73.

A plurality of divergent inner wings 85, outer wings 87, and brackets 79 are attached along the length of the angle 73 and rib 71 to comprise the flameholder. Each bracket is formed with an inner and outer seat, 81 and 83 respectively to accommodate the inner and outer wing 85 and 87 respectively. The inner and outer wings in combination with the radiation shields define the vee-shaped trough. The inner and outer wings are each formed with primary air holes 89 and 91 respectively along the entire length of the flameholder. As is shown in FIG. 3, the primary air holes in inner and outer wings are staggered relative to one another. An inner gap 93 is defined between the inner wing and the angle member 73 and an outer gap 95 is defined between the outer wing and inner wing to further cool the flameholder.

Referring to FIGS. 2 and 3, each flameholder may also include a flameholder extension 97 interposed between the flameholder and the burner wall. The flameholder extension may be formed from a wire mesh screen and is positioned adjacent to and immediately upstream from the burner throat 57. The flameholder extension acts as a baffle between the wall and the flameholder to reduce the velocity of exhaust gases flowing between the wall and the flameholder thereby contributing to the stability of the burner flame.

The performance of the invention as practiced in one embodiment may be described as follows. Gas turbine exhaust gas at 860° entered an HRSG combustion section duct at a velocity of 37.4 feet per second. The inlet temperature of the exhaust gas into the combustion section could vary from 400° to 900°F. The nominal dimension of the combustion section duct was 10 feet by 25 feet and a total of six wall burners were used in the configuration shown in FIG. 3. The angle $\alpha$ was on the order of 27° from the horizontal plane. The burners employed were Voorheis Gasiform wall burners which are operable with light-to-heavy fuels including residual oil. Under the aforementioned conditions the exhaust gas temperature was raised approximately 540° to 1400°F.

While there is shown what is considered, at present, to be the preferred embodiment of the invention, it is, of course, understood that various other modifications may be made therein. It is intended to claim all such modifications as fall within the true spirit and scope of the invention.

What is claimed is:

1. In a heat exchange apparatus of the type including an exhaust gas inlet and an exhaust gas outlet interconnected by a duct; said duct including a boiler tube section for passing a fluid in a non-contact heat exchange relation with the exhaust gas for raising the temperature of said fluid; and, improved combustion means for raising the temperature of said duct exhaust gas upstream from said boiler tube section, the improvement comprising:

a. a plurality of wall burners arranged about the perimeter of said duct; each wall burner including a nozzle portion having an axial centerline directed into said duct;

b. each wall burner having, associated therewith, a flameholder comprising an elongated trough having one end disposed adjacent one duct wall upstream from said burner nozzle portion; and, the other end directed toward an opposite duct wall; each flameholder being approximately parallel to its respective wall burner nozzle axial centerline.

2. In a heat recovery steam generator comprising an exhaust gas inlet and an exhaust gas outlet interconnected by a duct containing a boiler tube section for passing a fluid in a non-contact heat exchange relation with said exhaust gas for raising the temperature of said boiler tube fluid; means for raising the exhaust gas temperature upstream from said boiler tube section comprising:

a. a combustion section defined by said duct and including a plurality of wall burners disposed in at least one duct wall, each wall burner including a nozzle portion having an axial centerline directed upstream with respect to the exhaust gas flow;

b. an elongated flameholder associated with each burner, and disposed within said duct; each flameholder having one end adjacent said burner nozzle and the other end directed toward an opposite duct wall; and, each flameholder approximately parallel to its respective burner nozzle portion axial centerline and upstream from said wall burner with respect to the exhaust gas flow.

3. The device recited in claim 2 wherein there are recessed openings in at least two opposite duct walls, each opening having a wall burner disposed therein.

4. The device recited in claim 2 wherein each wall burner is an air-atomized, liquid fuel burner and wherein combustion is initiated upstream of the burner nozzle with respect to the liquid fuel supply.

5. The device recited in claim 2 wherein the combustion section is a rectangular duct upstream from said boiler tube section and said wall burners are disposed on two opposite walls.

6. The device recited in claim 2 wherein each burner nozzle centerline axis is at an angle $\alpha$ with respect to a plane perpendicular to the exhaust gas flow.

7. The device recited in claim 6 wherein the angle $\alpha$ is in a range of from 0° to 45°.

8. The device recited in claim 2 wherein each flameholder is substantially a vee-shaped trough.

9. The device recited in claim 2 wherein each flameholder comprises:

a. an elongated support comprising an angle and a support rib;

b. a plurality of bracket pairs attached to said support rib and said angle and spaced apart along the length of said flameholder;

c. inner and outer wings attached to each bracket pair; and d. a plurality of radiation shield flat plates attached across the vee of said angle and disposed along the length of said flameholder, said plates included between said bracket pairs and said inner and outer wings defining substantially a vee-shaped trough.

10. The device recited in claim 9 wherein each bracket is formed with an inner and outer seat for accommodating respectively inner and outer wings in a discontinuous, overlapping, substantially parallel relation.

11. The device recited in claim 9 wherein the inner and outer wings are formed with primary air holes to support combustion along the length of said flameholder.

12. The device recited in claim 9 wherein cooling gaps are defined between the angle and the inner wings; and, wherein cooling gaps are defined between the inner and outer wings.

13. The device recited in claim 9 wherein the angle includes a plurality of cooling holes formed therein for cooling the radiation plates.

14. The device recited in claim 9 further including a porous screen element between the flameholder end adjacent the duct wall and the burner nozzle.

15. In a heat recovery steam generator including an exhaust gas inlet and an exhaust gas outlet interconnected by a substantially rectangular duct including a boiler tube section for passing a fluid in a non-contact heat exchange relation with said exhaust gas for raising the temperature of said boiler tube fluid; means for raising the exhaust gas temperature upstream from said boiler tube section comprising:

a. a plurality of recessed openings formed within at least two opposite duct walls upstream from said boiler tube section;

b. a wall burner disposed in each opening having a nozzle portion axial centerline directed upstream into the exhaust gas flow;

c. an elongated flameholder associated with each burner and disposed in said duct; each flameholder comprising a substantially vee-shaped trough having one end adjacent said burner nozzle and a free opposite end extending approximately to the duct centerline; and, each flameholder approximately parallel to its respective burner nozzle portion axial centerline upstream from the burner with respect to the exhaust gas flow.

16. The device recited in claim 15 wherein the burner is an air-atomized, liquid fuel wall burner.

* * * * *